US012495906B2

(12) United States Patent
Sun

(10) Patent No.: US 12,495,906 B2
(45) Date of Patent: Dec. 16, 2025

(54) TELESCOPIC STOOL

(71) Applicant: Ningbo Tenghao Outdoor Co., Ltd., Ningbo (CN)

(72) Inventor: Liang Sun, Ningbo (CN)

(73) Assignee: NINGBO TENGHAO OUTDOOR CO., LTD., Ningbo (CN)

( * ) Notice: Subject to any disclaimer, the term of this patent is extended or adjusted under 35 U.S.C. 154(b) by 134 days.

(21) Appl. No.: 18/385,893

(22) Filed: Oct. 31, 2023

(65) Prior Publication Data

US 2024/0057776 A1 Feb. 22, 2024

Related U.S. Application Data

(63) Continuation-in-part of application No. 17/342,532, filed on Jun. 8, 2021, now Pat. No. 11,832,731, which (Continued)

(30) Foreign Application Priority Data

Aug. 26, 2020 (CN) ..... 202010872517.5
Sep. 21, 2020 (CN) ..... 202010995000.5

(51) Int. Cl.

| | |
|---|---|
| ***A47C 9/10*** | (2006.01) |
| ***A47C 3/16*** | (2006.01) |
| ***A47C 3/20*** | (2006.01) |
| ***A47C 3/40*** | (2006.01) |
| ***A47C 4/04*** | (2006.01) |
| ***A47C 4/52*** | (2006.01) |

(52) U.S. Cl.

CPC ..... *A47C 9/10* (2013.01); *A47C 3/16* (2013.01); *A47C 3/20* (2013.01); *A47C 3/40* (2013.01); *A47C 4/04* (2013.01); *A47C 4/52* (2013.01)

(58) Field of Classification Search

CPC .... A47C 9/10; A47C 3/16; A47C 3/20; A47C 3/40; A47C 4/04; A47C 4/52

See application file for complete search history.

(56) References Cited

U.S. PATENT DOCUMENTS 3,715,996 A * 2/1973 Rolfshus ..... A47C 9/10 D6/692.3
9,987,181 B2 * 6/2018 Hochman ..... A47C 3/20
(Continued)

*Primary Examiner* — Robert Canfield
(74) *Attorney, Agent, or Firm* — MATTHIAS SCHOLL P.C.; Matthias Scholl

(57) ABSTRACT

A telescopic stool, including: a first connection ring, a second connection ring, a plurality of clamping seats, a plurality of anti-deformation members, and a plurality of tightening members. The second connection ring is disposed on an upper part of an inner side of the first connection ring; the plurality of clamping seats are equidistantly disposed on a lower part of an inner side of the second connection ring; the plurality of anti-deformation members are clamped on the plurality of clamping seats, respectively; the plurality of tightening members are disposed on the plurality of clamping seats, respectively; each of the plurality of anti-deformation members comprises an active connection seat, a fixed block, a first active clamping block, an active connection rod, a second active clamping block, a support block, an elastic spring, and a fixed support rod; the active connection seat is clamped on the plurality of clamping seats.

7 Claims, 4 Drawing Sheets

Related U.S. Application Data is a continuation-in-part of application No. PCT/CN2021/079326, filed on Mar. 5, 2021.

(56) References Cited

U.S. PATENT DOCUMENTS

| | | | | | |
|---|---|---|---|---|---|
| D873,042 | S | * | 1/2020 | Dai | D6/335 |
| D878,067 | S | * | 3/2020 | You | D6/353 |
| 10,631,646 | B1 | * | 4/2020 | Zaifman | A47B 3/002 |
| D891,798 | S | * | 8/2020 | Dai | D6/335 |
| D893,204 | S | * | 8/2020 | Dai | D6/335 |
| D899,117 | S | * | 10/2020 | Dai | D6/351 |
| D918,609 | S | * | 5/2021 | Zhao | D6/351 |
| D936,382 | S | * | 11/2021 | Long | D6/353 |
| D938,207 | S | * | 12/2021 | Long | D6/686 |
| 11,369,239 | B2 | * | 6/2022 | Yang | A47K 11/04 |
| D957,834 | S | * | 7/2022 | Sun | D6/353 |
| D959,865 | S | * | 8/2022 | Dai | D6/352 |
| 11,576,494 | B1 | * | 2/2023 | You | A47C 3/20 |
| 11,832,731 | B2 | * | 12/2023 | Sun | A47C 7/72 |
| 2020/0015592 | A1 | * | 1/2020 | Zaifman | A47C 3/40 |
| 2022/0061534 | A1 | * | 3/2022 | Sun | A47C 7/725 |
| 2022/0087427 | A1 | * | 3/2022 | Sun | A47C 3/20 |

* cited by examiner

TELESCOPIC STOOL

CROSS-REFERENCE TO RELAYED APPLICATIONS

This application is a continuation in part of U.S. Ser. No. 17/342,532 filed on Jun. 8, 2021, now pending, which is a continuation-in-part of International Patent Application No. PCT/CN2021/079326 with an international filing date of Mar. 5, 2021, designating the United States, now pending, and further claims foreign priority benefits to Chinese Patent Application No. 202010872517.5 filed Aug. 26, 2020, and to Chinese Patent Application No. 202010995000.5 filed Sep. 21, 2020. The contents of all of the aforementioned applications, including any intervening amendments thereto, are incorporated herein by reference.

BACKGROUND

The disclosure relates to the technical field of stools, and more particularly to a telescopic stool.

Stools are widely in various locations, such as bedrooms, offices, laboratories and outdoor places. Conventional stools have a fixed shape and size and are bulky and not portable. In recent years, telescopic stools have been developed. After stretched, the telescopic stools need to be supported by a reliable support force. Although the existing telescopic structures can realize a telescopic function, the support effects of the telescopic structures need to be improved, and the load-bearing capacities of the telescopic stools are limited.

SUMMARY

To overcome the deficiencies in the related art, the disclosure provides a telescopic stool that is effective in resisting deformation and has a high load-bearing capacity.

To achieve the above objective, the disclosure provides a telescopic stool, comprising a first connection ring, a second connection ring, a plurality of clamping seats, a plurality of anti-deformation members, and a plurality of tightening members. The second connection ring is disposed on an upper part of an inner side of the first connection ring; the plurality of clamping seats are equidistantly disposed on a lower part of an inner side of the second connection ring; the plurality of anti-deformation members are clamped on the plurality of clamping seats, respectively; the plurality of tightening members are disposed on the plurality of clamping seats, respectively; each of the plurality of anti-deformation members comprises an active connection seat, a fixed block, a first active clamping block, an active connection rod, a second active clamping block, a support block, an elastic spring, and a fixed support rod; the active connection seat is clamped on the plurality of clamping seats; the fixed block is fixed on one end of the active connection seat; the first active clamping block is rotatably connected to the fixed block; the first active clamping block is fixedly connected to one end of the active connection rod, and the other end of the active connection rod is fixedly connected to the second active clamping block; the second active clamping block is rotatably connected to the support block; each support block is fixedly connected to two fixed support rods, and each fixed support rod is disposed through the upper part of the first connection ring.

In a class of this embodiment, two adjacent ends of two adjacent second active clamping blocks are fixedly connected to two ends of the elastic spring, respectively; bottom ends of two adjacent first active clamping blocks are fixedly connected to two ends of an elastic rope.

In a class of this embodiment, the plurality of tightening members each comprise a connection seat, an L-shaped clamp rod, a threaded connecting rod, and a threaded fastening cap; the connection seat is disposed on the active connection seat and is located at an outer bottom of the second connection ring; the L-shaped clamp rod is disposed on two top sides of the connection seat; the threaded connecting rod is fixedly connected to a front end to the L-shaped clamp rod; and the threaded connecting rod is disposed through the upper part of the first connection ring and in threaded connection to the threaded fastening cap.

In a class of this embodiment, two press blocks are fixedly connected to two sides of a front end of the fixed support rod, respectively, and the two press blocks are disposed on the upper part of the first connection ring in the vicinity of the fixed support rod; and the two press blocks and the first connection ring are detachably connected to fourth anchor bolts.

In a class of this embodiment, the active connection seat is detachably connected to each of the plurality of clamping seats through a first anchor bolt.

In a class of this embodiment, the first active clamping block is detachably connected to the fixed block through a second anchor bolt.

In a class of this embodiment, the second active clamping block is detachably connected to the support block through a third anchor bolt.

The following advantages are associated with the telescopic stool of the disclosure:

1. Under the cooperation of the components comprising the active connection seat, the fixed block, the first active clamping block, the active connection rod, the second active clamping block, the support block, the elastic spring, and the elastic rope, the produced telescopic stool is effective in resisting deformation and has a high load-bearing capacity.
2. Under the cooperation of the components comprising the connection seat, the L-shaped clamp rod, the threaded connecting rod, and the threaded fastening cap, the produced telescopic stool is easy to assemble and disassemble.

Figure 1:
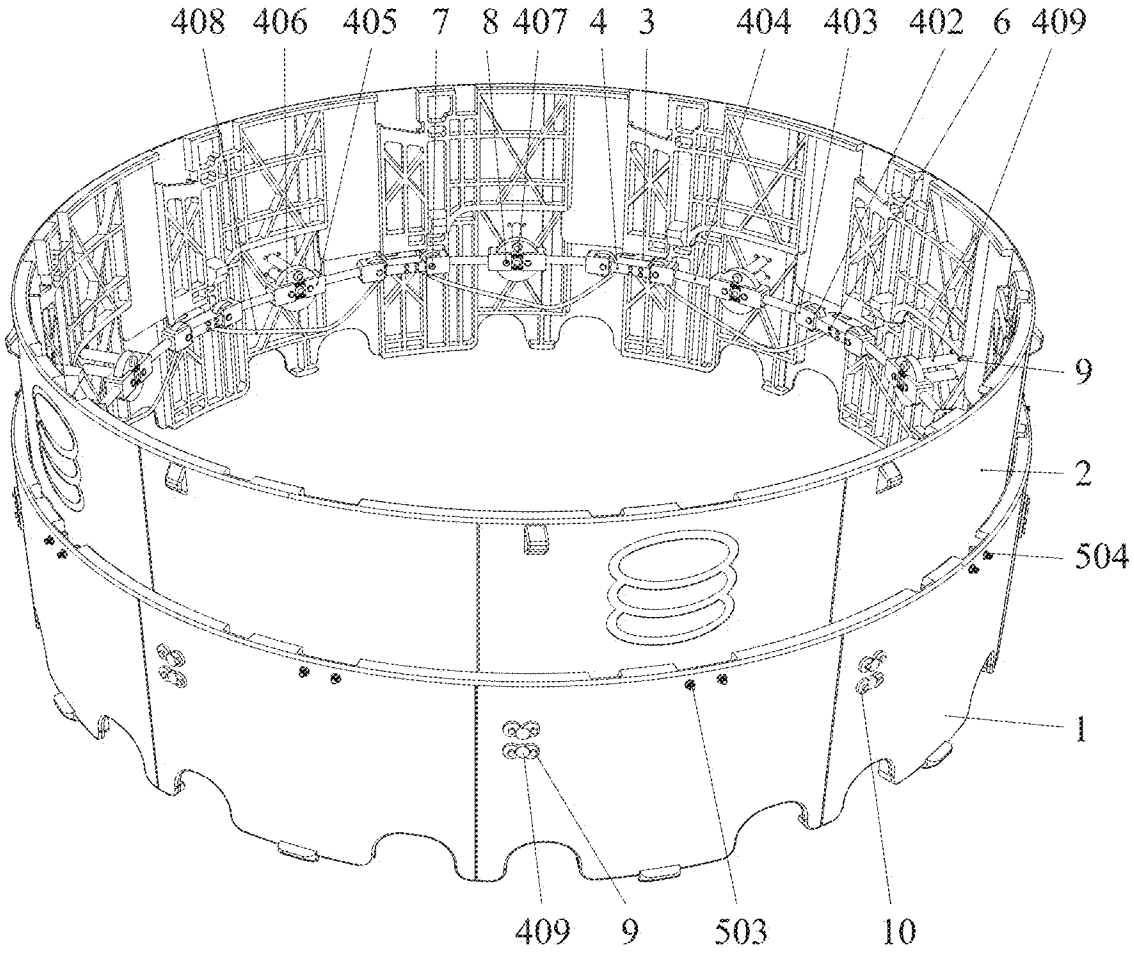
FIG. 1 is a schematic diagram of a telescopic stool in accordance with one embodiment of the disclosure.

In the drawings, the following reference numbers are used: 1. First connection ring; 2. Second connection ring; 3. Clamping seat; 4. Anti-deformation member; 401. Active connection seat; 402. Fixed block; 403. First active clamping block; 404. Active connection rod; 405. Second active clamping block; 406. Support block; 407. Elastic spring; 408. Elastic rope; 409. Fixed support rod; 5. Tightening member; 501. Connection seat; 502. L-shaped clamp rod; 503. Threaded connecting rod; 504. Threaded fastening cap; 6. First anchor bolt; 7. Second anchor bolt; 8. Third anchor bolt; 9. Fourth anchor bolt; 10. Press block.

DETAILED DESCRIPTION

To further illustrate the disclosure, embodiments detailing a telescopic stool are described below. It should be noted that the following embodiments are intended to describe and not to limit the disclosure.

Figure 2:
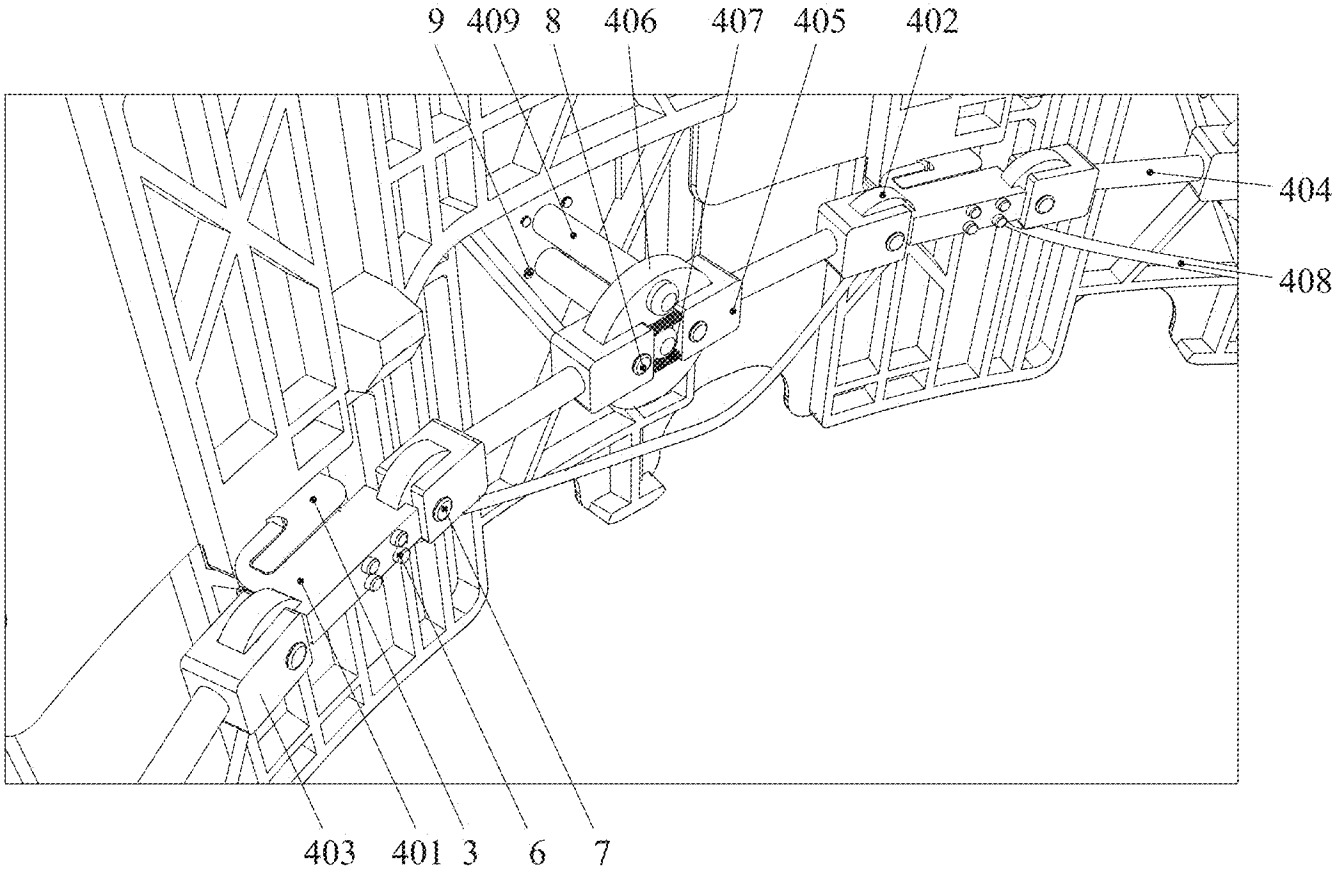
FIG. 2 is a first local enlarged view of a telescopic stool in accordance with one embodiment of the disclosure.
Figure 3:
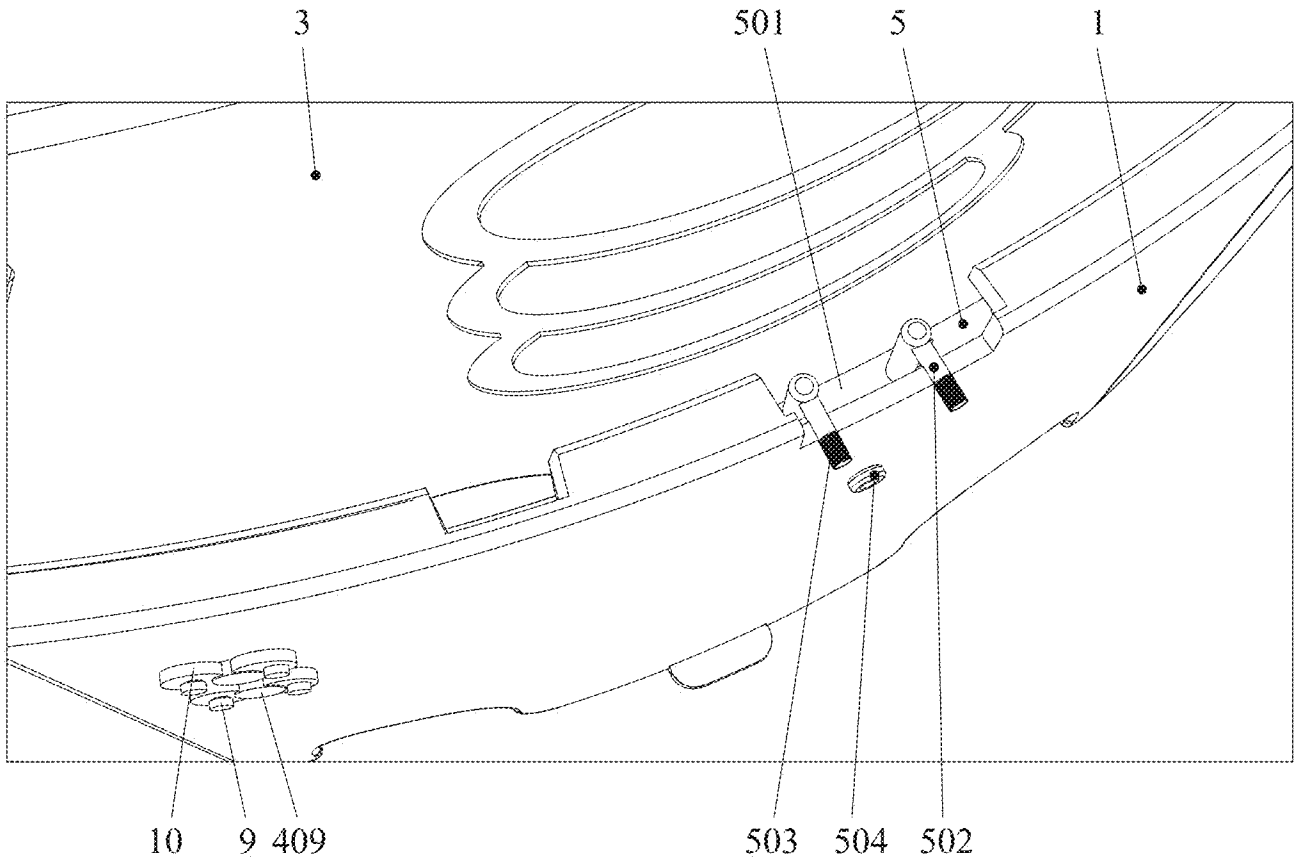
FIG. 3 is a second local enlarged view of a telescopic stool in accordance with one embodiment of the disclosure.
Figure 4:
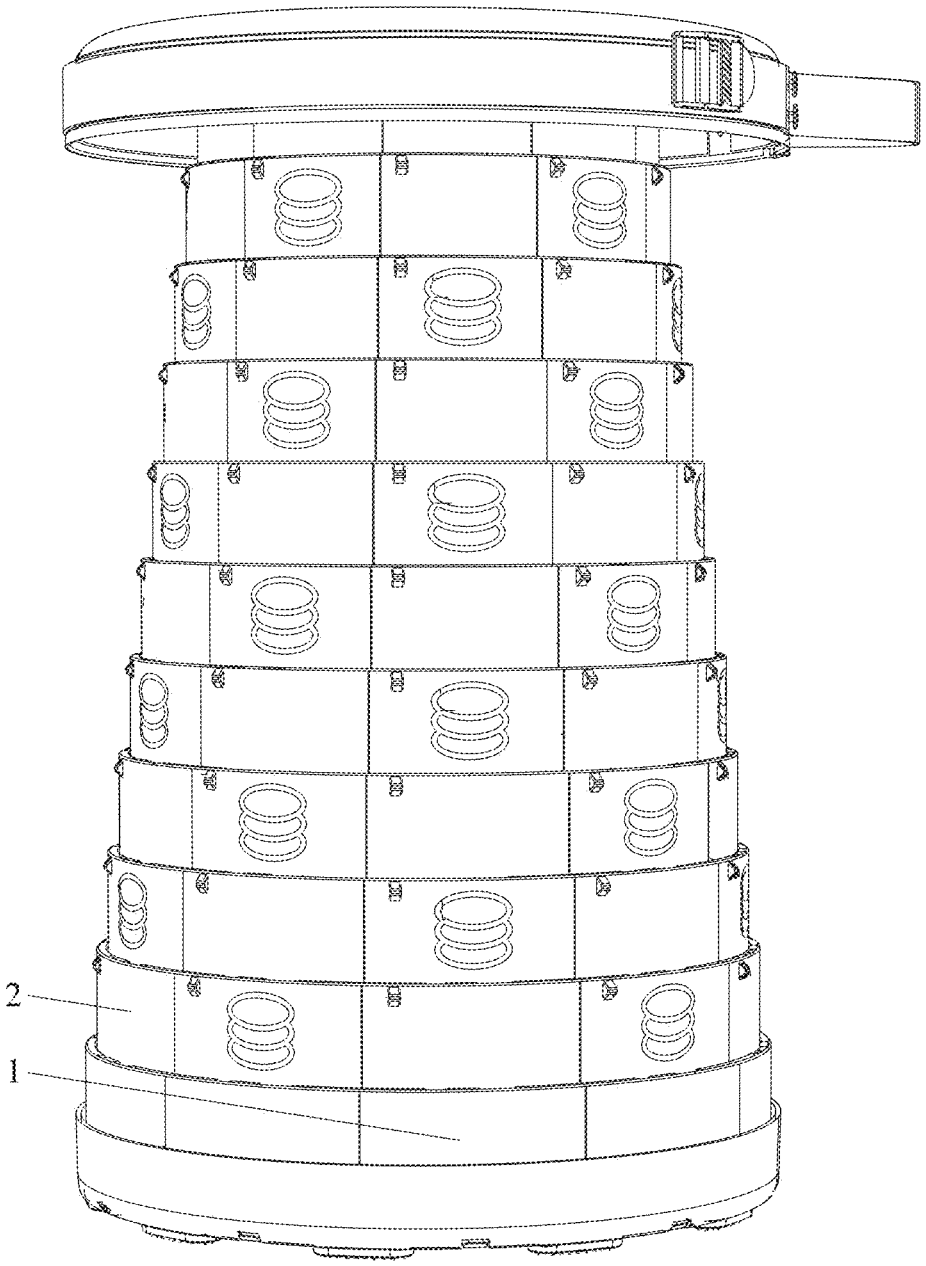
FIG. 4 is a front view of a telescopic stool in accordance with one embodiment of the disclosure.

As shown in FIGS. 1-4, a telescopic stool is provided, comprising a first connection ring 1, a second connection ring 2, a plurality of clamping seats 3, a plurality of anti-deformation members 4, and a plurality of tightening members 5. The second connection ring 2 is disposed on an upper part of an inner side of the first connection ring 1; the plurality of clamping seats 3 are equidistantly disposed on a lower part of an inner side of the second connection ring 2; the plurality of anti-deformation members 4 are clamped on the plurality of clamping seats 3, respectively; the plurality of tightening members 5 are disposed on the plurality of clamping seats 3, respectively; each of the plurality of anti-deformation members 4 comprises an active connection seat 401, a fixed block 402, a first active clamping block 403, an active connection rod 404, a second active clamping block 405, a support block 406, an elastic spring 407, and a fixed support rod 409; the active connection seat 401 is clamped on the plurality of clamping seats 3; the fixed block 402 is fixed on one end of the active connection seat 401; the first active clamping block 403 is rotatably connected to the fixed block 402; the first active clamping block 403 is fixedly connected to one end of the active connection rod 404, and the other end of the active connection rod 404 is fixedly connected to the second active clamping block 405; the second active clamping block 405 is rotatably connected to the support block 406; each support block 406 is fixedly connected to two fixed support rods, and each fixed support rod is disposed through the upper part of the first connection ring 1. When the second connection ring 2 is subject to pressure, the two first active clamping blocks 403 rotate downwards on the fixed block 402. As the fixed block 402 rotates downwards, the active connection rod 404 and the second active clamping block 405 connected to the fixed block also rotate downwards on the support block 406. The support block 406 is supported on the first connection ring 1 through the fixed support rod 409, and when the second connection ring 2 is pressed downwards, the first active clamping block 403, the fixed support rod 409, and the second active clamping block 405 on the first connection ring 1 are then rotated downwards to support and resist deformation.

Two adjacent ends of two adjacent second active clamping blocks 405 are fixedly connected to two ends of the elastic spring 407, respectively; bottom ends of two adjacent first active clamping blocks 403 are fixedly connected to two ends of an elastic rope 408. Through the arrangement of the elastic spring 407 on the second active clamping block 405, the second active clamping block 405 can quickly rebounds when being pressed down. The elastic rope 408 is used to connect two adjacent first active clamping blocks 403 with each other, and to synchronize the movement of the two adjacent first active clamping blocks 403 when being pressed to fall down and open up.

The plurality of tightening members 5 each comprise a connection seat 501, an L-shaped clamp rod 502, a threaded connecting rod 503, and a threaded fastening cap 504; the connection seat 501 is disposed on the active connection seat 401 and is located at an outer bottom of the second connection ring 2; the L-shaped clamp rod 502 is disposed on two top sides of the connection seat 501; the threaded connecting rod 503 is fixedly connected to a front end to the L-shaped clamp rod 502; and the threaded connecting rod 503 is disposed through the upper part of the first connection ring 1 and in threaded connection to the threaded fastening cap 504. The two L-shaped clamp rods 502 and the threaded connecting rods 503 on each connection seat 501 are threaded on the upper part of the first connection ring 1, and both the L-shaped clamp rods 502 and the threaded connecting rods 503 are connected and fastened to the first connection ring 1 by means of the threaded fastening caps 504, securing the fixing of the second connection ring 2 and the first connection ring 1 and facilitating the disassembly thereof.

Two press blocks 10 are fixedly connected to two sides of a front end of the fixed support rod 409, respectively, and the two press blocks 10 are disposed on the upper part of the first connection ring 1 in the vicinity of the fixed support rod 409; and the two press blocks 10 and the first connection ring 1 are detachably connected to fourth anchor bolts 9. The press blocks 10 are fixed on the fixed support rod 409. After the fixed support rod 409 passes through the first connection ring 1, the press blocks 10 are in threaded connection to the first connection ring 1 via the fourth anchor bolts 9, which is easy to disassemble.

The active connection seat 401 is detachably connected to each of the plurality of clamping seats 3 through a first anchor bolt 6, which is easy to disassemble and assemble.

The first active clamping block 403 is detachably connected to the fixed block 402 through a second anchor bolt 7, which is easy to disassemble and assemble.

The second active clamping block 405 is detachably connected to the support block 406 through a third anchor bolt 8, which is easy to disassemble and assemble.

When the second connection ring 2 is subject to pressure, the two first active clamping blocks 403 rotate downwards on the fixed block 402. As the fixed block 402 rotates downwards, the active connection rod 404 and the second active clamping block 405 connected to the fixed block also rotate downwards on the support block 406. The support block 406 is supported on the first connection ring 1 through the fixed support rod 409, and when the second connection ring 2 is pressed downwards, the first active clamping block 403, the fixed support rod 409, and the second active clamping block 405 on the first connection ring 1 are then rotated downwards to support and resist deformation. Thus, the telescopic stool is effective in resisting deformation and has a high load-bearing capacity.

It will be obvious to those skilled in the art that changes and modifications may be made, and therefore, the aim in the appended claims is to cover all such changes and modifications.

What is claimed is:

1. A telescopic stool, comprising:

a first connection ring;

a second connection ring;

a plurality of clamping seats;

a plurality of anti-deformation members; and a plurality of tightening members;

wherein:

the second connection ring is disposed on an upper part of an inner side of the first connection ring;

the plurality of clamping seats are equidistantly disposed on a lower part of an inner side of the second connection ring;

the plurality of anti-deformation members is clamped on the plurality of clamping seats, respectively;

the plurality of tightening members is disposed on the plurality of clamping seats, respectively;

each of the plurality of anti-deformation members comprises an active connection seat, a fixed block, a first active clamping block, an active connection rod, a second active clamping block, a support block, an elastic spring, and a fixed support rod;

the active connection seat is clamped on the plurality of clamping seats;

the fixed block is fixed on one end of the active connection seat;

the first active clamping block is rotatably connected to the fixed block;

the first active clamping block is fixedly connected to one end of the active connection rod, and the other end of the active connection rod is fixedly connected to the second active clamping block; the second active clamping block is rotatably connected to the support block; each support block is fixedly connected to two fixed support rods, and each fixed support rod is disposed through the upper part of the first connection ring.

2. The telescopic stool of claim 1, wherein two adjacent ends of two adjacent second active clamping blocks are fixedly connected to two ends of the elastic spring, respectively; bottom ends of two adjacent first active clamping blocks are fixedly connected to two ends of an elastic rope.

3. The telescopic stool of claim 1, wherein the plurality of tightening members each comprise a connection seat, an L-shaped clamp rod, a threaded connecting rod, and a threaded fastening cap; the connection seat is disposed on the active connection seat and is located at an outer bottom of the second connection ring; the L-shaped clamp rod is disposed on two top sides of the connection seat; the threaded connecting rod is fixedly connected to a front end to the L-shaped clamp rod; and the threaded connecting rod is disposed through the upper part of the first connection ring and in threaded connection to the threaded fastening cap.

4. The telescopic stool of claim 1, wherein two press blocks are fixedly connected to two sides of a front end of the fixed support rod, respectively, and the two press blocks are disposed on the upper part of the first connection ring in the vicinity of the fixed support rod; and the two press blocks and the first connection ring are detachably connected to fourth anchor bolts.

5. The telescopic stool of claim 1, wherein the active connection seat is detachably connected to each of the plurality of clamping seats through a first anchor bolt.

6. The telescopic stool of claim 1, wherein the first active clamping block is detachably connected to the fixed block through a second anchor bolt.

7. The telescopic stool of claim 1, wherein the second active clamping block is detachably connected to the support block through a third anchor bolt.

* * * * *